US007513810B1

(12) United States Patent
Pelini

(10) Patent No.: US 7,513,810 B1
(45) Date of Patent: Apr. 7, 2009

(54) JACK PLATE

(75) Inventor: Mark Pelini, Valrico, FL (US)

(73) Assignee: RSM Intellectual Holdings Inc, Tampa, FL (US)

( * ) Notice: Subject to any disclaimer, the term of this patent is extended or adjusted under 35 U.S.C. 154(b) by 0 days.

(21) Appl. No.: 11/906,708

(22) Filed: Oct. 3, 2007

(51) Int. Cl.
*B63H 5/125* (2006.01)

(52) U.S. Cl. ..... 440/61 R

(58) Field of Classification Search ..... 440/61 R
See application file for complete search history.

(56) References Cited

U.S. PATENT DOCUMENTS 4,890,811 A * 1/1990 Ehni ..... 248/642
6,409,556 B1 * 6/2002 Vance ..... 440/61 R
6,890,227 B1 * 5/2005 Alby et al. ..... 440/61 R

* cited by examiner

*Primary Examiner*—Stephen Avila
(74) *Attorney, Agent, or Firm*—Edward P Dutkiewicz

(57) ABSTRACT

An outboard motor jack plate comprising a transom mounting portion having a top and bottom. A motor mounting portion has a top and a bottom. There is a top cross support and a bottom cross support. Also included is a hydraulic cylinder having a ram and a casing.

5 Claims, 5 Drawing Sheets

4
4
3
38
36
68
12
86
70
14
48
16
24
46
10
130
116
114
3

68
46
12
10
114

FIG 3
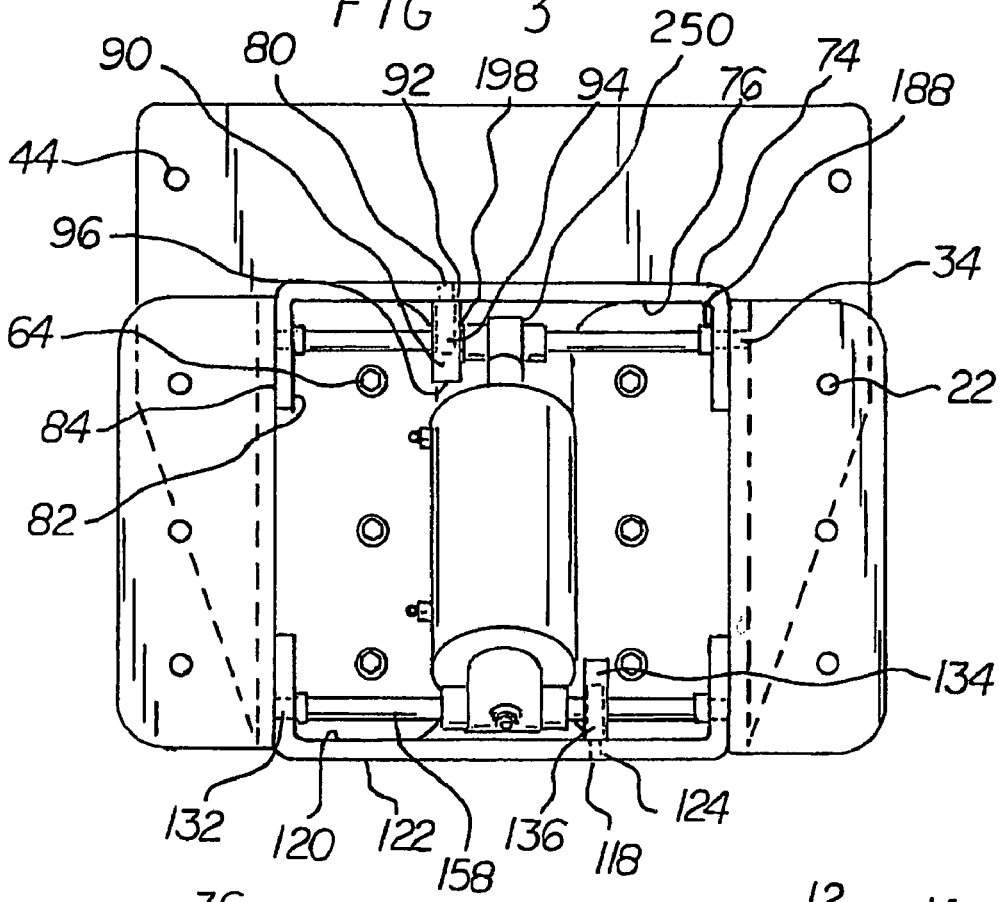
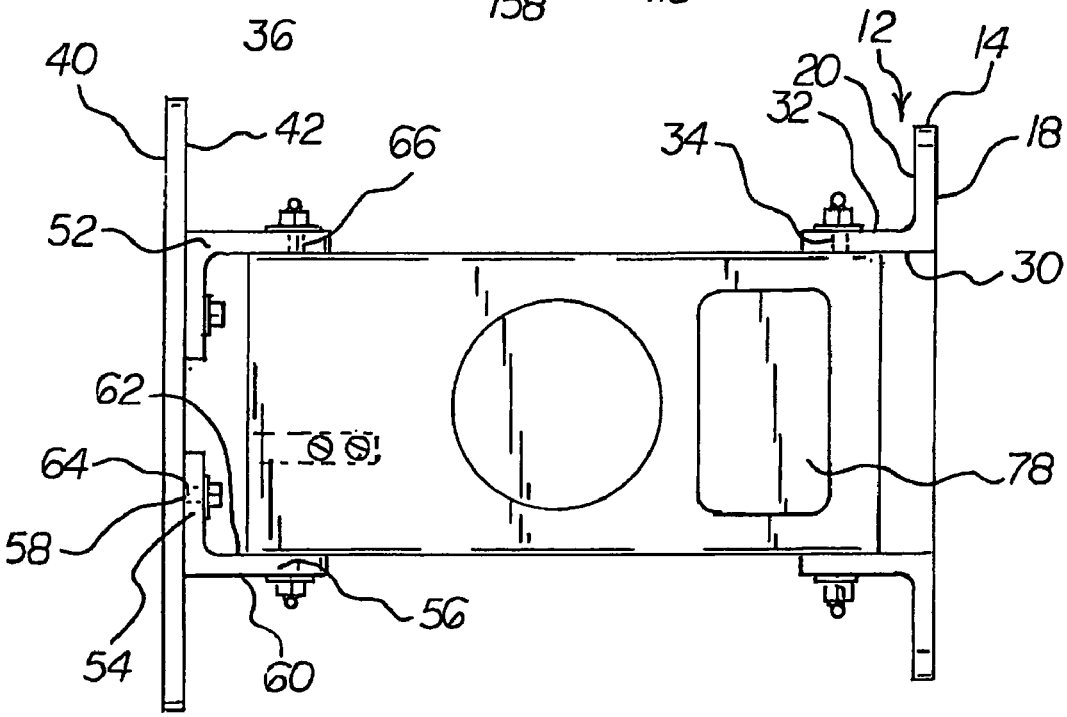
FIG 4

FIG 5
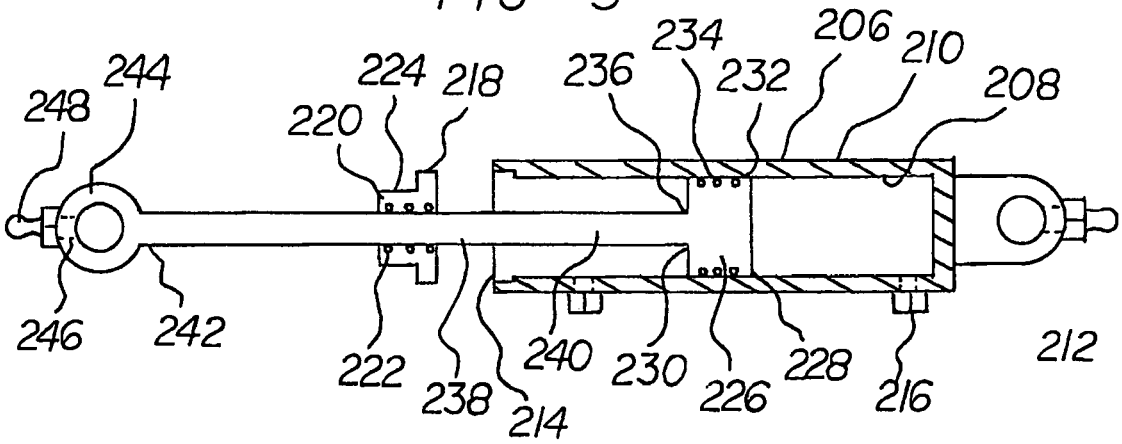
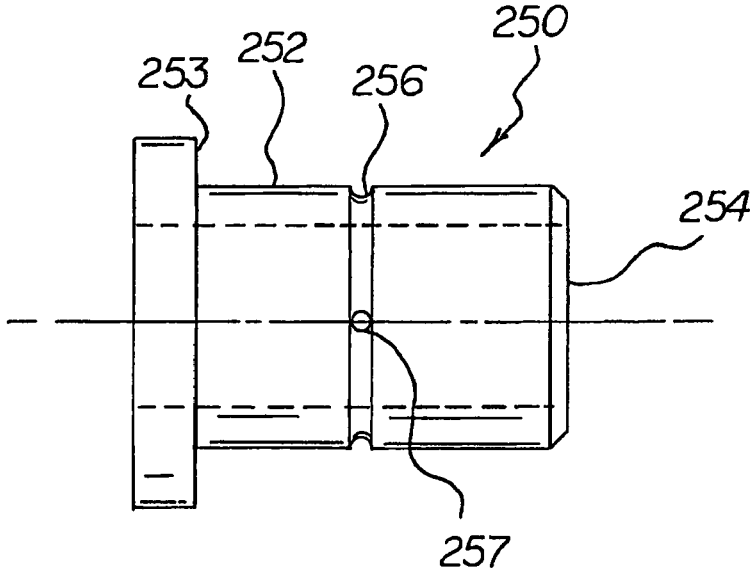
FIG 6

FIG 7
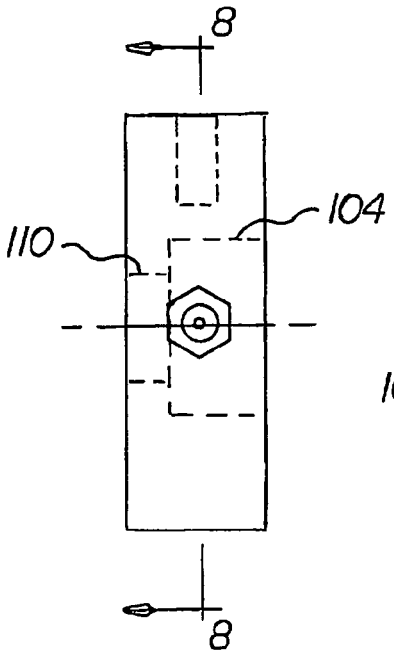
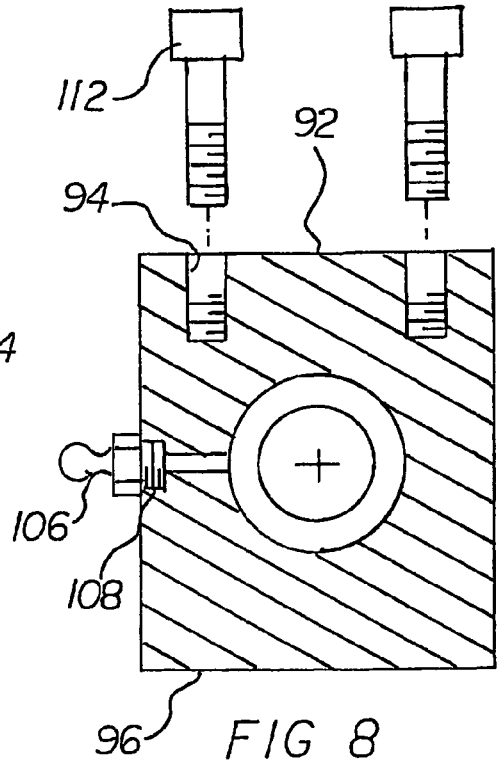
FIG 8
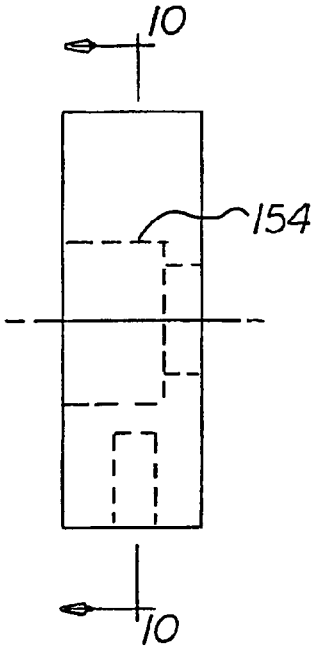
FIG 9
FIG 10
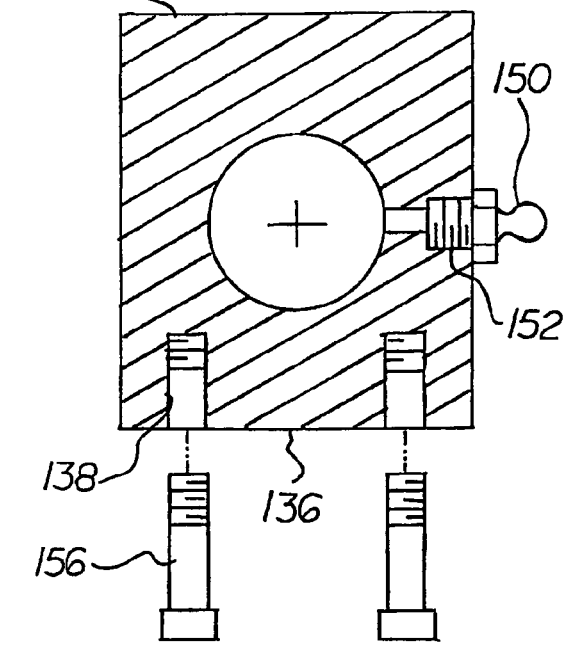

FIG 11
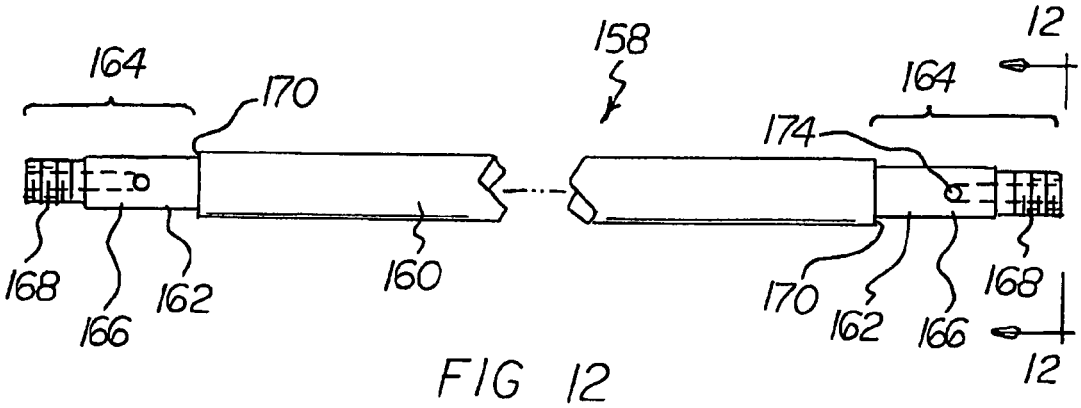
FIG 12
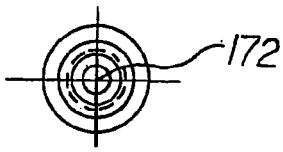
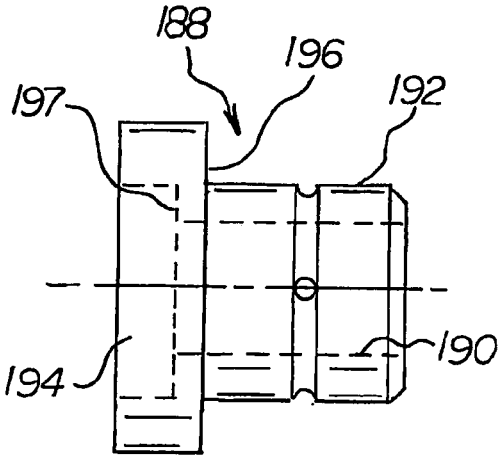
FIG 13
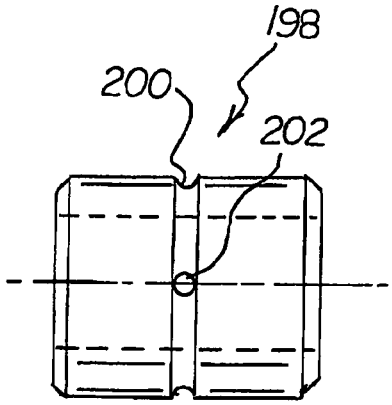
FIG 14

JACK PLATE

BACKGROUND OF THE INVENTION

1. Field of the Invention

The present invention relates to a jack plate and more particularly pertains to a means for elevating an outboard motor mounted on a boat transom.

2. Description of the Prior Art

The use of other means of elevating an outboard motor is known in the prior art. More specifically, other means of elevating an outboard motor previously devised and utilized for the purpose of raising or lowering an outboard motor are known to consist basically of familiar, expected, and obvious structural configurations, notwithstanding the myriad of designs encompassed by the crowded prior art which has been developed for the fulfillment of countless objectives and requirements. An information disclosure statement is hereto attached.

While these devices fulfill their respective, particular objectives and requirements, the aforementioned patents do not describe jack plate that provides a device for elevating an outboard motor mounted on a boat transom.

In this respect, the jack plate according to the present invention substantially departs from the conventional concepts and designs of the prior art, and in doing so provides an apparatus primarily developed for the purpose of a means for elevating an outboard motor mounted on a boat transom.

Therefore, it can be appreciated that there exists a continuing need for a new and improved jack plate which can be used for a means for elevating an outboard motor mounted on a boat transom. In this regard, the present invention substantially fulfills this need.

SUMMARY OF THE INVENTION

In view of the foregoing disadvantages inherent in the known types of other means of elevating an outboard motor now present in the prior art, the present invention provides an improved jack plate. As such, the general purpose of the present invention, which will be described subsequently in greater detail, is to provide a new and improved jack plate and method which has all the advantages of the prior art and none of the disadvantages.

To attain this, the present invention essentially comprises an outboard motor jack plate comprising several component, in combination.

First provided is a proximal transom mounting portion. Proximal is defined as being at a location toward or near a transom of a boat. Distal is defined as being at a location further away from the transom of the boat than is the proximal location.

The transom mounting portion is fabricated of aluminum. The transom mounting portion has a transom plate and a pair of like-configured mounting braces. The transom plate has a generally rectilinear configuration with a flat inward transom-facing surface and a flat outward surface, with a thickness there between. The transom plate lies in a plane.

The transom plate has a plurality of bolt holes there through with each of the holes hole having an associated bolt. The bolt passes through the transom plate and through a boat transom for removably coupling the transom plate to the boat transom.

Each of the like-configured mounting braces of the transom mounting portion is fabricated of aluminum. Each of the braces has a generally flat rectilinear configuration with a flat inner face and a flat outer face, with a thickness there between. Each transom plate brace is coupled to the transom plate. Each brace is oriented parallel with the other brace. Each brace lies in a plane perpendicular to the plane of the rectilinear transom plate. Each brace has a pair of parallel-ly oriented strut holes of a first diameter therein.

Next provided is a distal motor mounting portion. The distal motor mounting portion is fabricated of aluminum. The distal motor mounting portion has a motor mounting plate. The motor plate has a generally rectilinear configuration with a flat outward motor facing surface and a flat inward surface, with a thickness there between. The motor mounting plate lies in a plane.

The motor mounting plate has a plurality of motor mounting bolt holes there through. Each of the bolt holes has an associated bolt. The bolt passes through the motor mounting plate and through a boat motor frame for removably coupling the motor mounting plate to the motor. The motor mounting plate has a plurality of threaded bracket holes therein.

Next provided is a pair of like-configured L-shaped mounting brackets. Each of the brackets is fabricated of aluminum. Each of the brackets has an inwardly oriented leg and a rearwardly oriented leg. Each L-shaped mounting bracket has a distal surface oriented toward the inward surface of the motor mounting plate and a rearwardly oriented side surface. Each L-shaped mounting bracket has an inwardly oriented L-shaped inner surface. Each L-shaped mounting bracket has a pair of bolt holes running from the proximal surface of the inwardly oriented leg to the distal surface of the inwardly oriented leg. Each L-shaped mounting bracket has a pair of parallel-ly oriented cross strut holes of the first diameter therein. The cross strut holes run from the side surface of the L-shaped bracket to the inner surface of the L-shaped bracket. Each of the cross strut holes has the first internal diameter.

Next provided is a top cross support. The top cross support is fabricated of aluminum. The top cross support has a generally C-shaped configuration with a pair of parallel downwardly oriented short legs and a horizontally oriented central section.

The central section of the top cross support has an upper surface and a lower surface, with a thickness there between. The central section has a slotted opening therein so as to lessen the weight of the cross support. The central section having a pair of mounting block holes there through.

Each of the short legs has an inward surface and an side surface, with a thickness there between. Each of the short legs has a slot therein to lessen the weight of the short leg. Each of the short legs has a pair of parallel-ly oriented strut holes of the first diameter therein. The strut holes of the short legs are each aligned with the strut holes of the L-shaped mounting bracket and also aligned with the strut holes in the transom plate brace.

The lower surface of the central section has a mounting block coupled there to. The mounting block has a generally rectilinear configuration with a top surface having a pair of threaded bolt holes therein and a bottom surface. The mounting block has a distal surface and a proximal surface and a pair of parallel side surfaces. The mounting block has a stepped strut hole there through.

The mounting block has a threaded grease fitting and a threaded grease fitting hole. The grease fitting hole passes from the proximal surface of the block to the stepped strut hole, thereby forming a communication between the grease fitting the strut hole.

The strut hole of the mounting has a second diameter and a third diameter there through, thereby forming a bushing retaining shoulder there, within the strut hole of the mounting block. The strut hole runs from side surface to side surface of the mounting block and is aligned with the strut holes of the short legs. There are provided a pair of bolts having a thread sized to be received by and mated to the bolt thread of the mounting block. The bolts couple the mounting block to the central section of the top cross support.

Next provided is a bottom cross support. The bottom cross support is fabricated of aluminum. The bottom cross support has a generally C-shaped configuration with a pair of parallel upwardly oriented short legs and a horizontally oriented central section.

The central section of the bottom cross support has an upper surface and a lower surface, with a thickness there between. The central section of the bottom cross support, unlike the central section of the top support, is solid, so as to form a splash barrier to prevent, or lessen, the amount of water that is splashed up and onto the motor. The central section has a pair of mounting block holes there through.

Each of the short legs of the bottom cross support has an inward surface and an side surface, with a thickness there between. Each of the short legs has a slot therein to lessen the weight of the short leg. Each of the short legs has a pair of parallel-ly oriented strut holes of the first diameter therein. The strut holes of the short legs are each aligned with the strut holes of the L-shaped mounting bracket and also aligned with the strut holes in the transom plate brace.

The upper surface of the central section has a mounting block coupled there to. The mounting block has a generally rectilinear configuration with a bottom surface having a pair of threaded bolt holes therein and a top surface. The mounting block has a distal surface and a proximal surface and a pair of parallel side surfaces. The mounting block has a stepped strut hole there through.

The mounting block has a threaded grease fitting and a threaded grease fitting hole. The grease fitting hole passes from the proximal surface of the block to the stepped strut hole, thereby forming a communication between the grease fitting the strut hole.

The strut hole of the mounting has a second diameter and a third diameter there through, thereby forming a bushing retaining shoulder there, within the strut hole of the mounting block. The strut hole runs from side surface to side surface of the mounting block and is aligned with the strut holes of the short legs. There are provided a pair of bolts having a thread sized to be received by and mated to the bolt thread of the mounting block. The bolts couple the mounting block to the central section of the bottom cross support.

Next provided are cross struts. The cross struts are each fabricated of a rigid material and having a generally solid round shaft configuration with a central axis. Each cross strut has an external diameter, being the second diameter. Each cross strut has a pair of opposing ends and a length there between. Each of the opposing ends of the cross struts has a coupling length. The coupling length has an external diameter of the first diameter. The coupling length has a smooth portion and a threaded portion. The threaded portion has an outside diameter of the first diameter. The first diameter being smaller than the second diameter, thereby forming a cross strut shoulder.

Each of the opposing ends of the cross struts has a centrally located grease passageway ending with a radially bored radial grease passageway. Each of the opposing ends of the cross struts has an associated end cap and thrust washer. The end cap has a center, with a grease passageway with a thread being located in the center of the end cap. The grease passageway has an associated threaded grease fitting to mate with the thread of the grease passageway in the end cap and the grease passageway of the upper cross strut end. The end cap has an associated thrust washer.

Next provided are a plurality of cross strut bushings. The bushings are fabricated of brass. Each of the bushings has an inner portion and an outer portion, with the inner and outer portions each having a same central axis and each being continuous with the other. The inner portion has a third external diameter and a centrally located passageway of the second diameter. The outer portion has an external diameter of the second diameter and a centrally located passageway of the first diameter. Each bushing has an external shoulder.

Next provided is a pair of mounting block bushings. Each mounting block bushing is fabricated of brass. Each mounting block bushing has an external diameter of the third diameter and an internal diameter of the second diameter. Each of the mounting block bushings is configured to be pressed into and retained in the stepped mounting block strut holes. The mounting block bushings each having a grease groove around the external diameter with a grease passageway running through the bushing to cause communication between the external grease groove and the internal diameter of the bushing.

Next provided is a hydraulic cylinder. The hydraulic cylinder has a tubular outer casing with an interior surface and an exterior surface. The outer casing has two opposing ends, with one end being a closed mounting end and the other end being an open ram end.

Each end of the cylinder has an associated hydraulic hose fitting communicating with the interior of the outer casing.

The hydraulic cylinder has a casing end cap having a ram passageway there through. The ram passageway has a plurality of associated hydraulic seals and a sleeve.

The hydraulic cylinder has a bi-directional piston located therein. The bi-directional piston has a mounting end and a ram end with a length there between. The piston has a plurality of hydraulic seal grooves and a plurality of O-ring hydraulic seals associated there with. The ram end of the piston has a ram receiving recess therein.

The hydraulic cylinder has an associated ram. The ram has a piston end, that is coupled to the hydraulic piston, and a working end, with a length there between.

The working end has a tubular end piece. The end piece being oriented in a plane perpendicular to the length of the ram. The end piece has an external diameter of a fourth diameter and an internal diameter of the third diameter, with the fourth diameter being larger than the third diameter. The end piece has a radially located grease hole and an associated grease fitting therein.

Next provided is an end piece bushing. The end piece bushing is fabricated of brass. The end piece bushing has an external surface and an internal surface. The external surface has an external diameter of the third diameter and the internal surface having a diameter of the second diameter. The internal surface has a grease groove there around. The grease groove is aligned with the grease fitting of the end piece.

Lastly provided is an associated hydraulic pump, a plurality of hydraulic hoses with fittings, and a pump control.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jack plate which has all of the advantages of the prior art other means of elevating an outboard motor and none of the disadvantages.

It is another object of the present invention to provide a new and improved jack plate which may be easily and efficiently manufactured and marketed.

It is further object of the present invention to provide a new and improved jack plate which is of durable and reliable constructions.

An even further object of the present invention is to provide a new and improved jack plate which is susceptible of a low cost of manufacture with regard to both materials and labor, and which accordingly is then susceptible of low prices of sale to the consuming public, thereby making such jack plate economically available to the buying public.

Even still another object of the present invention is to provide a jack plate for a means for elevating an outboard motor mounted on a boat transom.

Lastly, it is an object of the present invention to provide a new and improved outboard motor jack plate comprising a transom mounting portion having a top and bottom. A motor mounting portion has a top and a bottom. There is a top cross support and a bottom cross support. Also included is a hydraulic cylinder having a ram and a casing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a view taken along line 3-3 of FIG. 1.

FIG. 4 is a view taken along line 4-4 of FIG. 1.

FIG. 5 is a cross sectional view of the hydraulic cylinder, showing the seals about the piston and the ram passageway.

FIG. 6 is a side elevational view of an end piece bushing. Note the grease groove and grease hole. Note also the flange, or shoulder.

FIG. 7 is a rear elevational view of the upper mounting block.

FIG. 8 is a view taken along line 8-8 of FIG. 7.

FIG. 9 is a front elevational view of the lower mounting block.

FIG. 10 is a view taken along line 10-10 of FIG. 9.

FIG. 11 is a cut away view of the cross strut. Note the end grease fitting hole and the radially placed grease passageway.

FIG. 12 is a view taken along line 12-12 of FIG. 11.

FIG. 13 is a side elevational view of a cross strut bushing having a flange.

FIG. 14 is a side elevational view of a bushing having a grease groove and a grease hole therein.

The same reference numerals refer to the same parts throughout the various Figures.

DESCRIPTION OF THE PREFERRED EMBODIMENT

Figure 1:
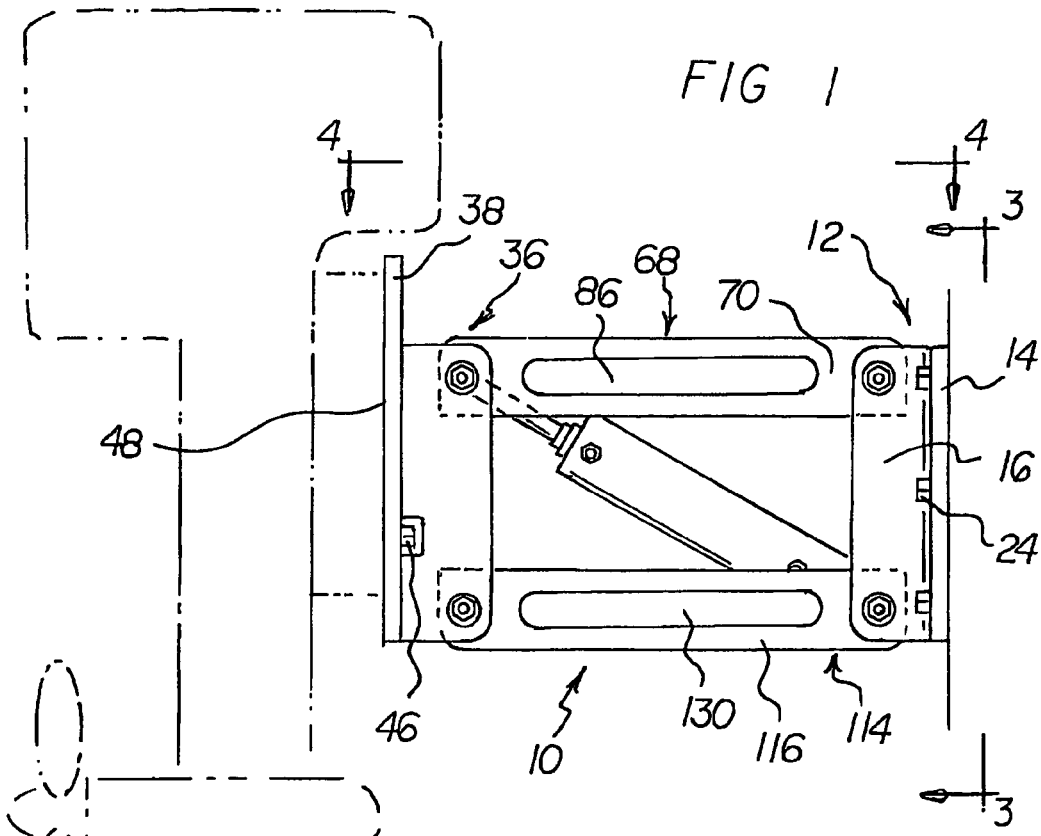
FIG. 1 is a side elevational view of the jack plate showing a motor in phantom. Note that the jack plate is extended, placing the motor in the lowest position.
Figure 2:
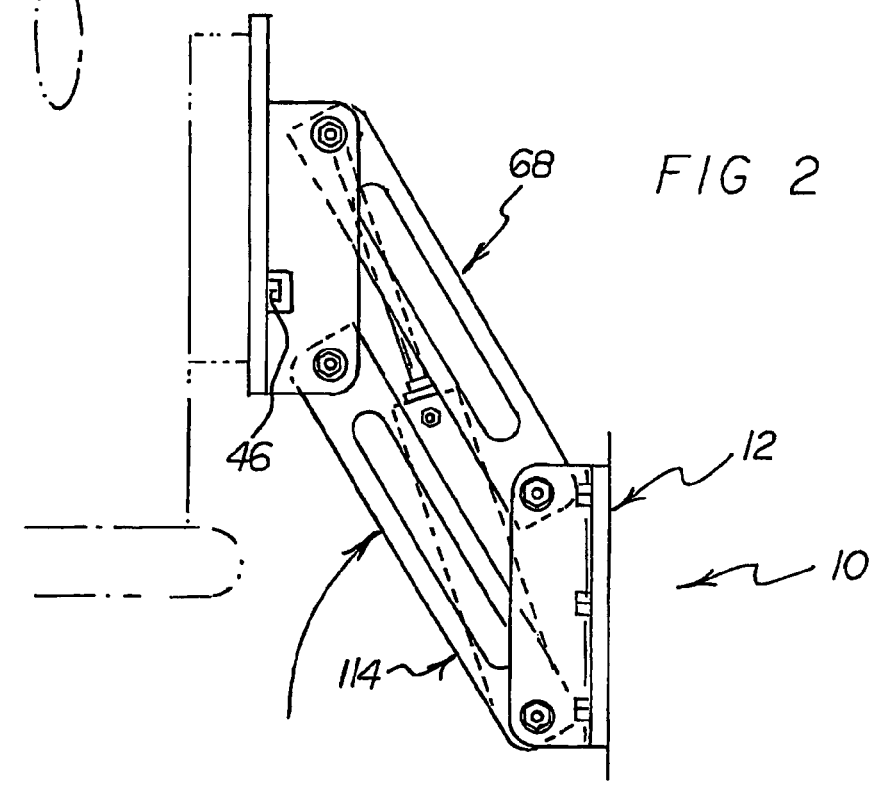
FIG. 2 is a side elevational view of the jack plate showing a motor in phantom. Note that the jack plate is in the raised position, placing the motor in the highest position.

With reference now to the drawings, and in particular to FIG. 1 thereof, the preferred embodiment of the new and improved jack plate embodying the principles and concepts of the present invention and generally designated by the reference numeral 10 will be described.

The present invention, the jack plate 10 is comprised of a plurality of components. Such components in their broadest context include a transom plate, a motor plate, a hydraulic cylinder and a pair of supports. Such components are individually configured and correlated with respect to each other so as to attain the desired objective.

First provided is a proximal transom mounting portion 12. Proximal is defined as being at a location toward or near a transom of a boat. Distal is defined as being at a location further away from the transom of the boat than is the proximal location.

In the preferred embodiment the transom mounting portion is fabricated of aluminum, though in other embodiments other rigid materials may be used. The materials may be naturally occurring or synthetic. Such materials may be from the class of rigid materials that includes metals, both magnetic and non-magnetic, composite materials, and alloys. The transom mounting portion has a transom plate 14 and a pair of like-configured mounting braces 16. The transom plate has a generally rectilinear configuration with a flat inward transom-facing surface 18 and a flat outward surface 20, with a thickness there between. The transom plate lies in a plane.

The transom plate has a plurality of bolt holes 22 there through with each of the holes hole having an associated bolt 24. The bolt passes through the transom plate and through a boat transom for removably coupling the transom plate to the boat transom.

In another embodiments, the transom plate may have inlets around the bolt holes so as to allow the bolt head being flush with the surface of the plate.

In the preferred embodiment each of the like-configured mounting braces of the transom mounting portion is fabricated of aluminum, though in other embodiments other rigid materials may be used. The materials may be naturally occurring or synthetic. Such materials may be from the class of rigid materials that includes metals, both magnetic and non-magnetic, composite materials, and alloys.

Each of the braces has a generally flat rectilinear configuration with a flat inner face 30 and a flat outer face 32, with a thickness there between. Each transom plate brace is coupled to the transom plate. Each brace is oriented parallel with the other brace. Each brace lies in a plane perpendicular to the plane of the rectilinear transom plate. Each brace has a pair of parallel-ly oriented strut holes 34 of a first diameter therein.

In the preferred embodiment the braces are continuous with the transom plate, and machined from a single ingot of aluminum.

In another embodiment each of the braces may be welded to the plate.

In another embodiment each of the braces may be bolted to the plate.

Next provided is a distal motor mounting portion 36. The distal motor mounting portion is, in the preferred embodiment, fabricated of aluminum. In another embodiment any rigid material, such as a metal, composite, or alloy could be used.

The distal motor mounting portion has a motor mounting plate 38. The motor plate has a generally rectilinear configuration with a flat outward motor facing surface 40 and a flat inward surface 42, with a thickness there between. The motor mounting plate lies in a plane.

The motor mounting plate has a plurality of motor mounting bolt holes 44 there through. Each of the bolt holes has an associated bolt 46. The bolt passes through the motor mounting plate and through a boat motor frame 48 for removably coupling the motor mounting plate to the motor. The motor mounting plate has a plurality of threaded bracket holes 50 therein.

Next provided is a pair of like-configured L-shaped mounting brackets 52. Each of the brackets is fabricated of aluminum, though in other embodiments other rigid material could be used. Such materials could be any metals, naturally occurring materials, composites, or alloys.

Each of the brackets has an inwardly oriented leg 54 and a rearwardly oriented leg 56. Each L-shaped mounting bracket has a distal surface 58 oriented toward the inward surface of the motor mounting plate and a rearwardly oriented side surface 60. Each L-shaped mounting bracket has an inwardly oriented L-shaped inner surface 62. Each L-shaped mounting bracket has a pair of bolt holes 64 running from the proximal surface of the inwardly oriented leg to the distal surface of the inwardly oriented leg. Each L-shaped mounting bracket has a pair of parallel-ly oriented cross strut holes 66 of the first diameter therein. The cross strut holes run from the side surface of the L-shaped bracket to the inner surface of the L-shaped bracket. Each of the cross strut holes has the first internal diameter.

Next provided is a top cross support 68. The top cross support is fabricated of aluminum, though, in another embodiment other rigid materials, such as metals, naturally occurring materials, composites, and alloys may be used. The top cross support has a generally C-shaped configuration with a pair of parallel downwardly oriented short legs 70 and a horizontally oriented central section 72.

The central section of the top cross support has an upper surface 74 and a lower surface 76, with a thickness there between. The central section has a slotted opening 78 therein so as to lessen the weight of the cross support. The central section having a pair of mounting block holes 80 there through.

Each of the short legs has an inward surface 82 and an side surface 84, with a thickness there between. Each of the short legs has a slot 86 therein to lessen the weight of the short leg. Each of the short legs has a pair of parallel-ly oriented strut holes 88 of the first diameter therein. The strut holes of the short legs are each aligned with the strut holes of the L-shaped mounting bracket and also aligned with the strut holes in the transom plate brace.

The lower surface of the central section has a mounting block 90 coupled there to. The mounting block has a generally rectilinear configuration with a top surface 92 having a pair of threaded bolt holes 94 therein and a bottom surface 96. The mounting block has a distal surface 98 and a proximal surface 100 and a pair of parallel side surfaces 102. The mounting block has a stepped strut hole 104 there through.

The mounting block has a threaded grease fitting 106 and a threaded grease fitting hole 108. The grease fitting hole passes from the proximal surface of the block to the stepped strut hole, thereby forming a communication between the grease fitting the strut hole.

The strut hole of the mounting has a second diameter and a third diameter there through, thereby forming a bushing retaining shoulder 110 there, within the strut hole of the mounting block. The strut hole runs from side surface to side surface of the mounting block and is aligned with the strut holes of the short legs. There are provided a pair of bolts 112 having a thread sized to be received by and mated to the bolt thread of the mounting block. The bolts couple the mounting block to the central section of the top cross support.

Next provided is a bottom cross support 114. The bottom cross support is, in the preferred embodiment, fabricated of aluminum, though, in another embodiment any rigid material such as metal, composites, or alloys could be used. The bottom cross support has a generally C-shaped configuration with a pair of parallel upwardly oriented short legs 116 and a horizontally oriented central section 118.

The central section of the bottom cross support has an upper surface 120 and a lower surface 122, with a thickness there between. The central section of the bottom cross support, unlike the central section of the top support, is solid, so as to form a splash barrier to prevent, or lessen, the amount of water that is splashed up and onto the motor. The central section has a pair of mounting block holes 124 there through.

Each of the short legs of the bottom cross support has an inward surface 126 and an side surface 128, with a thickness there between. Each of the short legs has a slot 130 therein to lessen the weight of the short leg. Each of the short legs has a pair of parallel-ly oriented strut holes 132 of the first diameter therein. The strut holes of the short legs are each aligned with the strut holes of the L-shaped mounting bracket and also aligned with the strut holes in the transom plate brace.

The upper surface of the central section has a mounting block 134 coupled there to. The mounting block has a generally rectilinear configuration with a bottom surface 136 having a pair of threaded bolt holes 138 therein and a top surface 140. The mounting block has a distal surface 142 and a proximal surface 144 and a pair of parallel side surfaces 146. The mounting block has a stepped strut hole 148 there through.

The mounting block has a threaded grease fitting 150 and a threaded grease fitting hole 152. The grease fitting hole passes from the proximal surface of the block to the stepped strut hole, thereby forming a communication between the grease fitting the strut hole.

The strut hole of the mounting has a second diameter and a third diameter there through, thereby forming a bushing retaining shoulder 154 there, within the strut hole of the mounting block. The strut hole runs from side surface to side surface of the mounting block and is aligned with the strut holes of the short legs. There are provided a pair of bolts 156 having a thread sized to be received by and mated to the bolt thread of the mounting block. The bolts couple the mounting block to the central section of the bottom cross support.

Next provided are cross struts 158. The cross struts are each fabricated of a rigid material and have a generally solid round shaft configuration 160 with a central axis. Each cross strut has an external diameter, being the second diameter. Each cross strut has a pair of opposing ends 162 and a length there between. Each of the opposing ends of the cross struts has a coupling length 164. The coupling length has an external diameter of the first diameter. The coupling length has a smooth 166 portion and a threaded portion 168. The threaded portion has an outside diameter of the first diameter. The first diameter being smaller than the second diameter, thereby forming a cross strut shoulder 170.

Each of the opposing ends of the cross struts has a centrally located grease passageway 172 ending with a radially bored radial grease passageway 174. Each of the opposing ends of the cross struts has an associated end cap 176 and thrust washer 178. The end cap has a center, with a grease passageway 180 with a thread 182 being located in the center of the end cap. The grease passageway has an associated threaded grease fitting 184 to mate with the thread of the grease passageway in the end cap and the grease passageway of the upper cross strut end. The end cap has an associated thrust washer 186.

Next provided are a plurality of cross strut bushings 188. The bushings are fabricated of brass. Each of the bushings has an inner portion 190 and an outer portion 192, with the inner and outer portions each having a same central axis and each being continuous with the other. The inner portion has a third external diameter and a centrally located passageway 194 of the second diameter. The outer portion has an external diameter of the second diameter and a centrally located passageway of the first diameter. Each bushing has an external shoulder 196, or flange.

Next provided is a pair of mounting block bushings 198. Each mounting block bushing is fabricated of brass. Each mounting block bushing has an external diameter of the third diameter and an internal diameter of the second diameter. Each of the mounting block bushings is configured to be pressed into and retained in the stepped mounting block strut holes. The mounting block bushings each having a grease groove 200 around the external diameter with a grease passageway 202 running through the bushing to cause communication between the external grease groove and the internal diameter of the bushing.

Next provided is a hydraulic cylinder 204. The hydraulic cylinder has a tubular outer casing 206 with an interior surface 208 and an exterior surface 210. The outer casing has two opposing ends, with one end being a closed mounting end 212 and the other end being an open ram end 214.

Each end of the cylinder has an associated hydraulic hose fitting 216 communicating with the interior of the outer casing.

The hydraulic cylinder has a casing end cap 218 having a ram passageway 220 there through. The ram passageway has a plurality of associated hydraulic seals 222 and a sleeve 224.

The hydraulic cylinder has a bi-directional piston 226 located therein. The bi-directional piston has a mounting end 228 and a ram end 230 with a length there between. The piston has a plurality of hydraulic seal grooves 232 and a plurality of O-ring hydraulic seals 234 associated there with. The ram end of the piston has a ram receiving recess 236 therein.

The hydraulic cylinder has an associated ram 238. The ram has a piston end 240, that is coupled to the hydraulic piston, and a working end 242, with a length there between.

The working end has a tubular end piece 244. The end piece being oriented in a plane perpendicular to the length of the ram. The end piece has an external diameter of a fourth diameter and an internal diameter of the third diameter, with the fourth diameter being larger than the third diameter. The end piece has a radially located grease hole 246 and an associated grease fitting 248 therein.

Next provided is an end piece bushing 250. The end piece bushing is fabricated of brass. The end piece bushing has an external surface 252 and an internal surface 254. The external surface has an external diameter of the third diameter and the internal surface having a diameter of the second diameter. The internal surface has a grease groove 256 there around. The grease groove is aligned with the grease fitting of the end piece.

Lastly provided is an associated hydraulic pump 258, a plurality of hydraulic hoses with fittings 260, and a pump control 262.

When in place the jack plate has two extremes of operation, the fully downward position, where the hydraulic cylinder ram is full retracted into the casing, and the fully upward position, where the hydraulic cylinder ram is fully extended. The jack plate can operate in any position between these two extremes. As can be readily seen, the jack plate takes the configuration of a parallelogram, with the transom plate and the motor plate remaining approximately parallel. The upper and lower supports also remain parallel, but vary in angle to the transom plate or motor plate. The hydraulic cylinder is positioned so that the mounting end is coupled to the transom plate at the lower cross strut. The working end of the hydraulic cylinder is coupled to the motor plate at the upper cross strut, thereby forming a diagonal between the motor mounting plate and the transom plate. Because the jack plate operates at the extremes of hydraulic cylinder piston travel, there is an intrinsic stop mechanism that prevents the over travel of the jack plate. Of course, the selection of the size of hydraulic cylinder is essential to setting the proper limits to travel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An outboard motor jack plate comprising, in combination:

a proximal transom mounting portion having strut holes therein;

a distal motor mounting portion having a motor mounting plate;

a pair of like-configured L-shaped mounting brackets having an inwardly oriented leg and a rearwardly oriented leg;

a top cross support having a pair of parallel downwardly oriented short legs and a horizontally oriented central section;

a bottom cross support having a pair of parallel upwardly oriented short legs and a horizontally oriented central section;

at least one cross strut;

at least one cross strut bushing;

at least mounting block bushing;

a hydraulic cylinder having a tubular outer casing and at least one hydraulic fitting and a mounting end and a working end;

an associated hydraulic pump, a plurality of hydraulic hoses to couple the hydraulic pump to the hydraulic cylinder, at least one fitting and a pump control;

the transom mounting portion having a transom plate and a pair of like-configured mounting braces, the transom plate having a generally rectilinear configuration with a flat inward transom facing surface and a flat outward surface with a thickness there between, the transom plate lying in a plane, the transom plate having a plurality of bolt holes there through with each hole having an associated bolt, the bolt passing through the transom plate and through a boat transom for removably coupling the transom plate to the boat transom;

the distal motor mounting portion motor plate having a generally rectilinear configuration with a flat outward motor facing surface and a flat inward surface with a thickness there between, the motor mounting plate having a plurality of motor mounting bolt holes there through with each hole having an associated bolt;

the like configured L-shaped mounting brackets each having a distal surface oriented toward the inward surface of the motor mounting plate and a rearwardly oriented side surface and an inwardly oriented L-shaped inner surface, each L-shaped mounting bracket having a pair of bolt holes running from the proximal surface of the inwardly oriented leg to the distal surface of the inwardly oriented leg, with each L-shaped mounting bracket having a pair of parallel-ly oriented cross strut holes therein;

the top cross support having a generally C-shaped configuration, the central section of the top cross support having an upper surface and a lower surface with a thickness there between, the central section having a pair of mounting block holes there through, each of the short leas having an inward surface and an side surface with a thickness there between, with each of the short legs having a pair of parallel-ly oriented strut holes of the first diameter therein with the strut holes of the short legs being aligned with the strut holes of the L-shaped mounting bracket, the lower surface of the central section having a mounting block coupled there to, the mounting block having a generally rectilinear configuration with a top surface having a pair of threaded bolt holes therein and a bottom surface and a distal surface and a proximal surface and a pair of parallel side surfaces, with the mounting block having a strut hole there through, with a pair of bolts having a thread sized to be received by and mated to the bolt thread of the mounting block, with the bolts coupling the mounting block to the central section of the top cross support;

the bottom cross support having a generally C-shaped configuration, the central section of the bottom cross support having an upper surface and a lower surface with a thickness there between, the central section having a pair of mounting block holes there through, each of the short leas having an inward surface and an side surface with a thickness there between, with each of the short legs having a pair of parallel-ly oriented strut holes of the first diameter therein with the strut holes of the short legs being aligned with the strut holes of the L-shaped mounting bracket, the upper surface of the central section having a mounting block coupled there to, the mounting block having a generally rectilinear configuration with a bottom surface having a pair of threaded bolt holes therein and a top surface and a distal surface and a proximal surface and a pair of parallel side surfaces, with the mounting block having a strut hole there through, with a pair of bolts having a thread sized to be received by and mated to the bolt thread of the mounting block, with the bolts coupling the mounting block to the central section of the bottom cross support;

the cross strut being fabricated of a rigid material and having a generally solid round shaft configuration with a central axis, each cross strut having the second external diameter with a pair of opposing ends and a length there between, with the first diameter being smaller than the second diameter;

the cross strut bushings each having an inner portion and an outer portion with the inner and outer portions having a same central axis and being continuous with each other, the inner portion having a third external diameter and a centrally located passageway of the second diameter;

the mounting block bushing each having an external diameter of the third diameter and an internal diameter of the second diameter; and the hydraulic cylinder having a tubular outer casing and a mounting end and a working end having an interior and an exterior and a pair of hydraulic fittings with one fitting being coupled to each end of the outer casing and communicating with the interior, the tubular outer casing having two opposing ends being the closed mounting end and an open ram end, the hydraulic cylinder having a piston located therein with the cylinder having a casing end cap having a ram passageway there through and a ram.

2. An outboard motor jack plate comprising:

a proximal transom mounting portion having strut holes therein;

a distal motor mounting portion having a motor mounting plate;

a pair of like-configured L-shaped mounting brackets having an inwardly oriented lea and a rearwardly oriented leg;

a top cross support having a pair of parallel downwardly oriented short legs and a horizontally oriented central section;

a bottom cross support having a pair of parallel upwardly oriented short leas and a horizontally oriented central section;

at least one cross strut;

at least one cross strut bushing;

at least mounting block bushing;

a hydraulic cylinder having a tubular outer casing and at least one hydraulic fitting and a mounting end and a working end;

an associated hydraulic pump, a plurality of hydraulic hoses to couple the hydraulic pump to the hydraulic cylinder, at least one fitting and a pump control;

each of the like-configured transom mounting portion braces being fabricated of aluminum and having a generally flat rectilinear configuration with a flat inner face and a flat outer face with a thickness there between, with each transom plate brace being coupled to the transom plate, with each brace being oriented parallel with the other plate and each plate being in a plane perpendicular to the plane of the rectilinear transom plate with each brace having the strut holes being parallel-ly oriented and of a first diameter;

the distal motor mounting portion motor plate being fabricated of aluminum and lying in a plane, the bolt passing through the motor mounting plate and through a boat motor frame for removably coupling the motor mounting plate to the motor, the motor mounting plate having a plurality of threaded bracket holes therein;

the like configured L-shaped mounting brackets being fabricated of aluminum, the cross strut holes running from the side surface of the L-shaped bracket to the inner surface of the L-shaped bracket with each of the cross strut holes having the first internal diameter;

the top cross support being fabricated of aluminum, with the central section having a slotted opening therein so as to lessen the weight of the cross support, each of the short legs having a slot therein to lessen the weight of the short leg, the mounting block having a stepped strut hole with an associated threaded grease fitting and a grease fitting hole, the grease fitting hole passing from the proximal surface of the mounting block, the grease fitting hole communicating with the stepped strut hole, the strut hole having a second diameter and a third diameter there through thereby forming a bushing retaining shoulder therein, the strut hole running from side surface to side surface of the mounting block and being aligned with the strut holes of the short legs and also aligned with the strut holes in the transom plate brace;

the bottom cross support being fabricated of aluminum with each of the short legs having a slot therein to lessen the weight of the short leg, the mounting block having a stepped strut hole with an associated threaded grease fitting and a grease fitting hole, the grease fitting hole passing from the proximal surface of the mounting block, the grease fitting hole communicating with the stepped strut hole, the strut hole having a second diameter and a third diameter there through thereby forming a bushing retaining shoulder therein, the strut hole running from side surface to side surface of the mounting block and being aligned with the strut holes of the short legs and also aligned with the strut holes in the transom plate brace;

the opposing ends of each of the cross struts having a coupling length of the first external diameter thereby forming a cross strut shoulder, the coupling length having a smooth portion and a threaded portion, the threaded portion having an outside diameter of the first diameter, each opposing ends of the cross struts having a centrally located grease passageway ending with a radially bored radial grease passageway, each of the opposing ends of the cross struts having an associated threaded end cap and associated thrust washer, with the end cap having a center, with a grease passageway with a thread being located in the center of the end cap, with the end cap grease passageway having an associated threaded grease fitting to mate with the thread of the grease passageway in the end and the grease passageway of the upper cross strut end;

the cross strut bushings each being fabricated of brass, the outer portion of each of the bushings having an external diameter of the second diameter and a centrally located passageway of the first diameter thereby forming a shoulder within the passageway there through;

the mounting block bushing each being fabricated of brass, with each of the mounting block bushings being configured to be pressed into and retained in the stepped mounting block strut holes, the mounting block bushings each having a grease groove around the external diameter with a grease passageway running through the bushing to cause communication between the grease groove and the internal diameter of the bushing; and the hydraulic cylinder end cap ram passageway having a plurality of associated hydraulic seals and a continuous sleeve, the hydraulic cylinder piston being a bi-directional piston, the bi-directional piston having a mounting end and a ram end with a length there between, the piston having a plurality of hydraulic seal grooves and a plurality of O-ring hydraulic seals associated there with, the ram end of the piston having a ram receiving recess therein, the ram having a piston end that is coupled to the hydraulic piston and a working end with a length there between, the working end having a tubular end piece with the end piece being oriented in a plane perpendicular to the length of the ram, the end piece having an external diameter of the third diameter and an internal diameter of the second diameter.

3. An outboard motor jack plate comprising:

a transom mounting portion having a top and bottom;

a motor mounting portion having a top and a bottom;

a top cross support;

a bottom cross support;

a hydraulic cylinder having a ram and a casing; and a strut having a central axis with two threaded opposing ends, with each threaded end having a grease passageway with an innermost extent along the central axis of the strut with each innermost extent of the grease passageway also having a radially oriented grease passageway, the strut having an associated threaded end cap, with the end cap having a centrally located threaded grease passageway therein, with the end cap having an associated grease fitting.

4. The outboard motor jack plate as described in claim 3 and further comprising an outboard motor being coupled to the motor mounting portion.

5. The outboard motor jack plate as described in claim 3 and further comprising:

the top cross support having at least one strut hole there in and at least one slot therein, the top support having a central section with at least one hole therein;

the bottom cross support having at least one strut hole there in and at least one slot therein; and the end cap having an associated thrust washer.

* * * * *